US008674795B2

(12) United States Patent
Reuber

(10) Patent No.: US 8,674,795 B2
(45) Date of Patent: Mar. 18, 2014

(54) MAGNETIC ACTUATOR WITH A NON-MAGNETIC INSERT

(71) Applicant: ABB Technology AG, Zurich (CH)

(72) Inventor: Christian Reuber, Willich (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 13/851,696

(22) Filed: Mar. 27, 2013

(65) Prior Publication Data

US 2013/0207752 A1 Aug. 15, 2013

Related U.S. Application Data

(63) Continuation of application No. PCT/EP2011/004830, filed on Sep. 27, 2011.

(30) Foreign Application Priority Data

Sep. 27, 2010 (EP) ..... 10010766

(51) Int. Cl.
*H01F 7/08* (2006.01)
*H01F 7/13* (2006.01)

(52) U.S. Cl.
USPC ..... 335/255; 335/179; 335/234; 335/257; 335/273; 335/277

(58) Field of Classification Search
USPC ..... 335/179, 234, 255, 257, 261, 274, 277, 335/279, 273
See application file for complete search history.

(56) References Cited

U.S. PATENT DOCUMENTS

| | | | | |
|---|---|---|---|---|
| 2,051,475 | A | 8/1936 | Grandstaff | |
| 5,508,487 | A * | 4/1996 | Smith et al. | 218/154 |
| 2008/0272659 | A1 | 11/2008 | Jeong et al. | |
| 2009/0039989 | A1 | 2/2009 | Reuber | |
| 2009/0189724 | A1 | 7/2009 | Golz et al. | |

FOREIGN PATENT DOCUMENTS

| | | | |
|---|---|---|---|
| DE | 71 05 342 | U | 5/1974 |
| DE | 10 2008 040073 | A1 | 1/2010 |

(Continued)

OTHER PUBLICATIONS

International Search Report (PCT/ISA/210) issued on Dec. 2, 2011, by the European Patent Office as the International Searching Authority for International Application No. PCT/EP2011/004830.

(Continued)

*Primary Examiner* — Ramon Barrera
(74) *Attorney, Agent, or Firm* — Buchanan Ingersoll & Rooney PC

(57) ABSTRACT

A magnetic actuator unit is provided for a circuit breaker, such as a medium voltage vacuum circuit breaker. The magnetic actuator unit includes a core, a coil, an actuating shaft, a first movable plate, a second movable plate, and a non-magnetic flat insert arranged between the core and the second movable plate. The magnetic actuator unit configured to switch the circuit breaker ON and OFF by moving the first movable plate between an ON position and an OFF position. The non-magnetic flat insert and the second movable plate are configured to adjust a holding force of the magnetic actuator unit provided by the second movable plate at the OFF position. The holding force is sufficient for holding the second movable plate at the OFF position against outer forces that are acting on the magnetic actuator unit.

11 Claims, 2 Drawing Sheets

(56) References Cited

FOREIGN PATENT DOCUMENTS

| | | | |
|---|---|---|---|
| DE | 10 2009 001706 | A1 | 9/2010 |
| EP | 1 843 375 | A1 | 10/2007 |
| JP | 58-075820 | A | 5/1983 |
| WO | WO 01/46968 | A1 | 6/2001 |
| WO | WO 03/030188 | A1 | 4/2003 |

OTHER PUBLICATIONS

Written Opinion (PCT/ISA/237) issued on Dec. 2, 2011, by the European Patent Office as the International Searching Authority for International Application No. PCT/EP2011/004830.

Search Report issued on May 25, 2011, by the European Patent Office for Application No. 10010766.3.

International Search Report (PCT/ISA/210) issued on Dec. 19, 2011, by the European Patent Office as the International Searching Authority for International Application No. PCT/EP2011/004829.

Written Opinion (PCT/ISA/237) issued on Dec. 19, 2011, by the European Patent Office as the International Searching Authority for International Application No. PCT/EP2011/004829.

Search Report issued on Feb. 9, 2011, by the European Patent Office for Application No. 10010812.5.

* cited by examiner

MAGNETIC ACTUATOR WITH A NON-MAGNETIC INSERT

RELATED APPLICATIONS

This application claims priority as a continuation application under 35 U.S.C. §120 to PCT/EP2011/004830, which was filed as an International Application on Sep. 27, 2011 designating the U.S., and which claims priority to European Application 10010766.3 filed in Europe on Sep. 27, 2010. The entire contents of these applications are hereby incorporated by reference in their entireties.

FIELD

The present disclosure relates to a magnetic actuator unit for a circuit breaker (e.g., a medium voltage vacuum circuit breaker), a circuit breaker and a magnetic actuator unit for switching the circuit breaker, the use of a magnetic actuator for switching a circuit breaker, and a method of assembling a magnetic actuator for a circuit breaker.

BACKGROUND INFORMATION

For the operation of a circuit breaker, such as a medium voltage vacuum circuit breaker, it can be necessary to generate a high force to press the first moving electrical contact to a second corresponding fixed electrical contact. The force can be generated by a magnetic actuator. The magnetic actuator includes a coil for generating an electrical field, a core for forming this field, and a first movable plate which is attracted by the core. When being attracted by the core, the movable plate generates the force used for closing the circuit breaker.

WO 01/46968 A1 discloses a variable reluctance solenoid which includes an armature and a yoke located axially beyond one end of the armature. Magnetic attraction across an axial gap between the armature and yoke causes the armature to move axially and close the gap. The armature includes ferromagnetic laminations lying in a plane perpendicular to the axial direction. These laminations can include slots, proportioned and directed to combat eddy currents and reduce moving mass while avoiding the creation of flux bottlenecks. The solenoid can have two yokes on opposite sides of the armature, providing reciprocating armature motion.

EP 1 843 375 A1 discloses an electro-magnetic actuator, such as for a medium voltage switch, having a first movable plate in form of a round yoke, an actuating shaft and a lower smaller second movable plate in the form of a lower smaller yoke which is fixedly spaced apart from the first movable plate and arranged at an opposite end of the core. A damping pad for mechanical damping is inserted between the core of the magnetic actuator and the small yoke.

However, the thickness of damping pads is generally too large to generate the required force to keep the system, for example, the magnetic actuator and external devices like one or more vacuum interrupters, fixed in an OPEN or OFF position. Generally, the required force in the OFF position is generated by the opening spring. The opening spring will generate the highest force in the ON position. Since the magnetic actuator is generally not able to magnetically generate its own locking force for the OFF position, the opening spring has to be designed in a way that it also helps to generate the locking force in the OFF position. Consequently, the mechanical energy for charging the opening spring during the closing operation is relatively high, and higher than required for obtaining the desired opening speed.

SUMMARY

An exemplary embodiment of the present disclosure provides a magnetic actuator unit for a circuit breaker. The magnetic actuator unit includes a core, a coil, an actuating shaft, a first movable plate, a second movable plate, and a non-magnetic flat insert arranged between the core and the second movable plate. The first movable plate is configured to be attracted by the core to a first position at a first side of the core when a magnetic field is generated by the coil, and to switch the circuit breaker to an ON position when being attracted by the core. The first movable plate and the second movable plate are spaced apart from one another in a fixed position at a distance, such that when the first movable part lifts off from the core with a stroke of the magnetic actuator unit to an OFF position, the second movable plate is configured to bear against the non-magnetic flat insert at a second position at a second side of the core opposite of the first position to generate a holding force of the magnetic actuator unit at the OFF position. The non-magnetic flat insert and the second movable plate are configured to adjust a holding force of the magnetic actuator unit provided by the second movable plate and sufficient for holding the second movable plate at the OFF position against forces that are acting from outside the magnetic actuator unit to the magnetic actuator unit.

An exemplary embodiment of the present disclosure provides a method of assembling a magnetic actuator unit for a circuit breaker. The exemplary method includes arranging a coil at a core of the magnetic actuator unit such that the coil is configured to generate a magnetic flux in the core, and movably arranging a first movable plate such that the first movable plate is movable on an actuating shaft between an ON position and an OFF position. The exemplary method also includes arranging a non-magnetic flat insert at another side of the core, opposite to the first moving plate. In addition, the exemplary method includes arranging a second movable plate below the non-magnetic flat insert and on the same actuating shaft where the first movable plate is arranged so that the non-magnetic flat insert lies between the core and the second movable plate. The non-magnetic flat insert and the second movable plate are configured to adjust a holding force of the magnetic actuator unit provided by the second movable plate and sufficient for holding the second movable plate at the OFF position against outer forces that are acting on the magnetic actuator unit.

BRIEF DESCRIPTION OF THE DRAWINGS

Additional refinements, advantages and features of the present disclosure are described in more detail below with reference to exemplary embodiments illustrated in the drawings.

DETAILED DESCRIPTION

Figure 1:
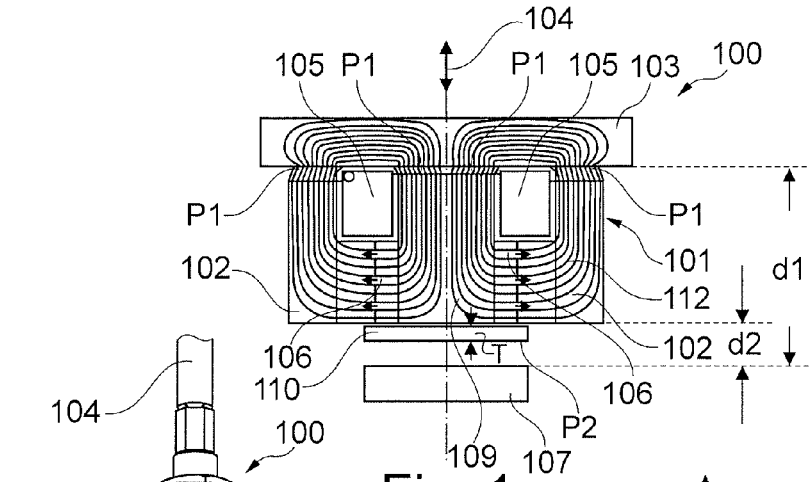
FIG. 1 shows a cross-sectional view of a magnetic actuator unit for a circuit breaker in an ON position according to an exemplary embodiment of the present disclosure.

Exemplary embodiments of the present disclosure provide a compact, flexible and efficient magnetic actuator for a circuit breaker.

An exemplary embodiment of the present disclosure provides a magnetic actuator unit for a circuit breaker, such as for a medium voltage vacuum circuit breaker, for example. The magnetic actuator unit is configured to switch the circuit breaker ON and OFF by moving a first movable plate on an actuating shaft through the core of the magnet between an ON position and an OFF position. The magnetic actuator unit includes a non-magnetic flat insert arranged between the core and a second movable plate, which is mounted onto the actuating shaft at a defined distance to the first moving plate. The non-magnetic flat insert and the second movable plate are configured to adjust a holding force of the magnetic actuator unit provided by the second movable plate at the OFF position. The holding force is sufficiently strong for holding the actuator unit in the OFF position against the outer forces that are acting on the magnetic actuator unit. No additional spring element is necessary for generating the holding force in the OFF position.

The non-magnetic flat insert and/or the second movable plate can be configured to adjust the holding force of the magnetic actuator provided by the second movable plate at the OFF position by adjusting the thickness of the non-magnetic flat insert and/or the thickness of the second movable plate and/or the width or diameter of the second movable plate.

In accordance with this exemplary embodiment, the present disclosure provides a relatively flat non-magnetic insert instead of a damping layer, wherein, according to the thickness of the non-magnetic insert, the holding force of the magnetic actuator in an OFF position or disconnected position can be adjusted according to the requirements of the system that is operated by the magnetic actuator. An opening spring can be omitted for holding the OFF position as the required holding force in the OFF position is generated by the second movable plate. The holding force can increase when decreasing the thickness of the non-magnetic flat insert, and the holding force can decrease when increasing the thickness of the non-magnetic flat insert.

Further adjustment of the holding force in OFF position can be made with a variation of the thickness and/or the width or diameter of the second movable plate.

According to an exemplary embodiment of the present disclosure, the magnetic actuator unit includes a fixing device configured to fix the non-magnetic flat insert to the core, for example, by means of a screw. It can be advantageous to use existing screws to fix the layer in a reliable way to the core. The fixing device can include at least one screw.

In accordance with an exemplary embodiment of the present disclosure, the non-magnetic flat insert can be made of stainless steel. The non-magnetic flat insert can have the form of a layer that can be optionally made of different non-magnetic materials as long as they comply with the expected number of operations and corrosion resistance of the magnetic actuator. Stainless steel is fulfilling both of these above-mentioned aspects.

Depending on the specific application, the non-magnetic flat insert is configured to adjust a holding force of the magnetic actuator, provided by the second movable plate at the OFF position, based on the distance between the second movable plate and the core, that is, based on the adjustment of the thickness of the non-magnetic flat insert. Generally, this dependency has a hyperbolic character.

In accordance with an exemplary embodiment of the present disclosure, the magnetic actuator unit includes a core element, at least two flanks surrounding the core element, and at least two permanent magnets arranged between the core element and the flanks. The second movable plate is configured to adjust a holding force of the magnetic actuator provided by the second movable plate at the OFF position based on a relation of the width of the second movable plate to the distance between the outer ends of the permanent magnets.

Due to the distribution and concentration of the magnetic flux and due to saturation effects in the iron parts, such as the core, the flanks and the second movable plate, the holding force has a maximum value when the width of the second movable plate is a little bit larger than the distance between the outer ends of the permanent magnets.

For wider second movable plates, the holding force decreases as the magnetic flux is less concentrated.

For narrower second movable plates, the holding force also decreases as the amount of magnetic flux is reduced due to the low content of iron and the high content of air in the magnetic circuit including the second movable plate.

In case the first movable plate is not rectangular but round, there is also a maximum holding force in the OFF position for a certain diameter of the second movable plate, but with a less accentuated peak due to the superposition of regions of the round second movable plate that are wider than the width between the outer ends of the permanent magnets, and other regions of the round second movable plate that are less wide.

In accordance with an exemplary embodiment of the present disclosure, the holding force of the magnetic actuator unit provided by the second movable plate at the OFF position is adapted based on the thickness of the second movable plate. In case the second movable plate is relatively thin, it can happen that the magnetic flux saturates areas of the second movable plate to such an extent that the magnetic resistance is increased significantly. Then, the amount of magnetic flux is reduced, and therefore also the magnetic locking force in the OFF position.

In order to reach a more compact design of the magnetic actuator unit, a circuit breaker and a magnetic actuator for switching the circuit breaker according to any one of the above- and below-mentioned exemplary embodiments is provided, wherein the magnetic actuator can be integrated in the circuit breaker. The use of such a magnetic actuator in a circuit breaker is provided according to another exemplary embodiment of the present disclosure.

An exemplary embodiment of the present disclosure provides a method of assembling a magnetic actuator for a circuit breaker. The exemplary method includes arranging a coil at a core of the magnetic actuator unit such that the coil generates a magnetic flux in the core, and movably arranging a first movable plate on an actuating shaft that goes through the core such that the first movable plate is movable between an ON position and an OFF position of the circuit breaker. In addition, the exemplary method includes arranging a non-magnetic flat insert at the other side of the core, opposite to the first movable plate, and then arranging a second movable plate below the non-magnetic flat insert and on the same actuating shaft where the first movable plate is arranged so that the non-magnetic flat insert lies between the core and the second movable plate of the magnetic actuator unit. The flat insert and the second movable plate are configured to adjust a holding force of the magnetic actuator unit provided by the second movable plate at the OFF position.

These and other aspects and advantages of the present disclosure will be apparent from and elucidated with reference to the exemplary embodiments described hereinafter.

FIG. 1 shows a magnetic actuator unit 100 for a circuit breaker according to an exemplary embodiment of the present disclosure. The circuit breaker may be a medium voltage vacuum circuit breaker, for example. The magnetic actuator unit 100 includes a core 101 with a core element 109, at least two flanks 102 surrounding the core element 109, and at least two permanent magnets 106 arranged between the core element 109 and the flanks 102. The magnetic actuator unit 100 is configured to switch the circuit breaker ON and OFF by moving a first movable plate 103 between an ON position and an OFF position. A non-magnetic insert 110 is arranged between a core 101 of the magnetic actuator unit 100 and a second movable plate 107.

The first movable plate 103 is attracted by the core 101 to a first position P1 at a first side of the core 101 when the magnetic field is generated by the coil 105. The coil 105 is configured to generate a magnetic flux 112 in the core 101. The first movable plate 103 is configured to move towards the core 101 when it is attracted by the core 101. The first movable plate 103 and the second movable plate 107 are spaced apart from one another in a fixed position at a distance d1, such that, if the first movable part 103 lifts off from the core 101 with a desired stroke of the magnetic actuator unit 100 in an OFF position, the second movable plate 107 bears against the non-magnetic flat insert 110 at a second side of the core 101 at a second position P2, opposite of the first position P1.

Figure 2:
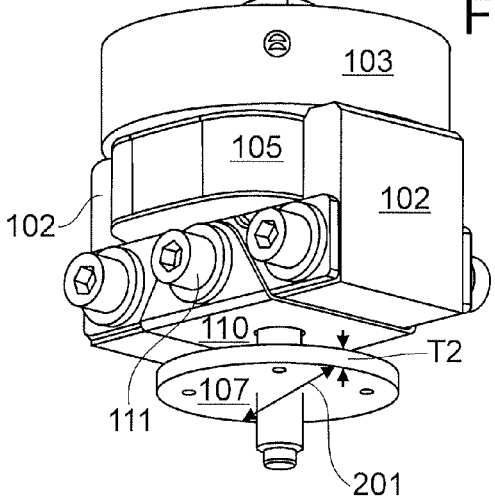
FIG. 2 shows a perspective view of a magnetic actuator unit for a circuit breaker in an ON position according to an exemplary embodiment of the present disclosure.

FIG. 2 shows a magnetic actuator unit 100 for a circuit breaker according to an exemplary embodiment of the present disclosure. The actuator is in position P1. In the example of FIG. 2, position P1 corresponds to the ON or closed position of a circuit breaker that is to be driven by the magnetic actuator unit. The non-magnetic flat insert 110 can include stainless steel and is arranged between the core 101 and the second movable plate 107. The non-magnetic flat insert 1100 can be fixed to the core or the second movable plate 107, for example by a fixing device 111.

The flat insert 110 is, together with the second movable plate 107, configured to adjust a holding force of the magnetic actuator unit 100 provided by the second movable plate 107 at the OFF position, for example, if the first movable plate 103 lifts off from the core 101 with a desired stroke of the magnetic actuator unit 100, possibly by adjusting the thickness T of the non-magnetic flat insert 110. An actuating shaft 104 is configured to guide the first movable plate 103 and the second movable plate 107 through the core 101.

FIG. 2 shows a magnetic actuator unit 100 for a circuit breaker, wherein the first movable plate 103 is fixed to the actuating shaft 104. The magnetic actuator unit 100 of FIG. 2 includes a coil, a core 101 with a core element, at least two flanks 102 surrounding the core element, and at least two permanent magnets arranged between the core element and the flanks according the magnetic actuator unit of FIG. 1. The magnetic actuator unit 100 illustrated in FIG. 2 differs from that of Figure in that the second movable plate 107 is a round plate with a diameter 201, and a non-magnetic flat insert 110 is provided which is fixed to the core by a screw 111.

Figure 3:
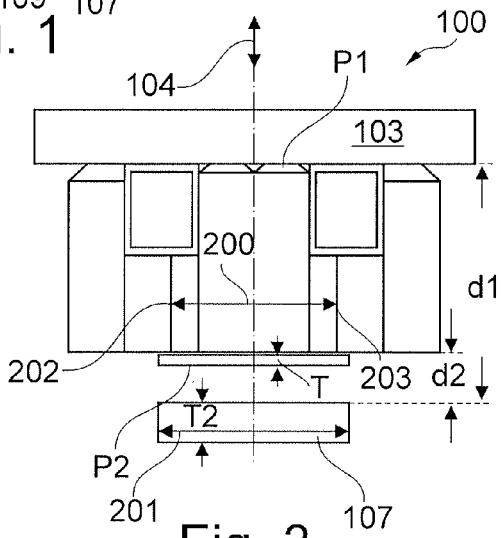
FIG. 3 shows a cross sectional view of a magnetic actuator unit for a circuit breaker according to FIG. 2.

FIG. 3 shows a cross-sectional view of the magnetic actuator unit 100 of FIG. 2. The thickness of the non-magnetic flat insert 110 is configured to adjust a holding force of the magnetic actuator unit 100 provided by the second movable plate 107 at the OFF position. The holding force decreases when increasing the thickness T of the non-magnetic flat insert 110, and an adjustment of the holding force based on a relation of the width 201 of the second movable plate 107 to the distance between the outer ends 202, 203 of the permanent magnets becomes less sensitive to the value of this relation.

The round second movable plate 107 provides a maximum holding force for a certain diameter 201, but with a less accentuated peak compared to a rectangular second movable plate 107 as shown in FIG. 1, due to the fact that some regions of the round second movable plate 107 are wider than the width 200 between the outer ends 202, 203 of the permanent magnets 106, and other regions of the round second movable plate 107 are less wide.

The magnetic locking force or holding force in the OFF position can also depend on the thickness T2 of the second movable plate 107. The magnetic flux that is generated by the permanent magnets 106 and guided by the core 101, respectively, the core element 109 and the flanks 102 passes finally through the plate 107 and thereby generates the holding or locking force. In case the second movable plate 107 is relatively thin, it can happen that the magnetic flux saturates areas of the second movable plate 107 to such an extent, that the magnetic resistance is increased significantly. Then, the amount of magnetic flux is reduced, and therefore the magnetic holding force is also in the OFF position.

The magnetic holding force in the OFF position can also depend on the thickness T of the non-magnetic layer or non-magnetic flat insert 110. Generally, this dependence is of a hyperbolic character. The iron in the second movable plate 107 can saturate if both the second movable plate 107 and the non-magnetic flat insert 110 are thin, because in this case the magnetic holding or locking force in OFF position will be reduced due to the saturation.

Figure 4:
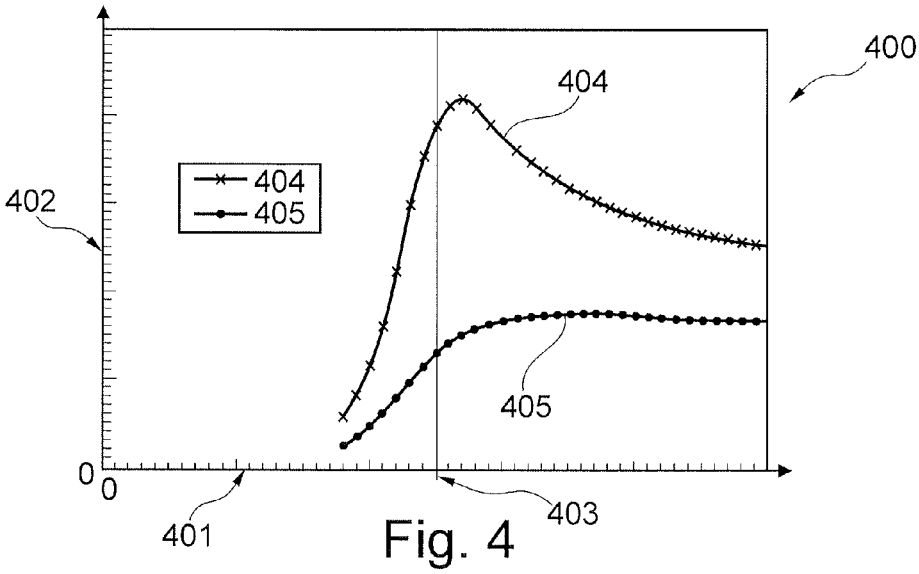
FIG. 4 shows a diagram describing the relation of the width of a second movable plate of the magnetic actuator unit according to FIGS. 1 to 3 to the distance between the outer ends of the permanent magnets of the core of the magnetic actuator unit.

FIG. 4 shows a diagram with a vertical holding force axis 402 depicting the principal shape of the holding or locking force, provided by the second movable plate in an OFF position, and a horizontal axis 401 depicting the width—or the diameter in case the second movable plate is round—of the second movable plate.

Graph 404 shows the principal shape of the holding force or magnetic locking force of a second movable plate and a non-magnetic flat insert with a relatively small thickness in relation to the dimensions of the other parts of the magnetic circuit, like the core 101, the permanent magnets 106, the flanks 102 and the second movable plate 107. The vertical line 403 shows the width 200 between the outer ends 202, 203 of the permanent magnets (see also FIG. 3). Graph 405 shows the holding force of the second movable plate and a non-magnetic flat insert with a larger thickness.

Due to the distribution and concentration of the magnetic flux and due to the saturation effects in the iron parts (the core, the flanks, the second movable plate), the holding force has a maximum value when the width of the second movable plate is a little bit larger than the distance between the outer ends of the permanent magnets.

For wider second movable plates, the holding force decreases as the magnetic flux is less concentrated.

For narrower second movable plates, the holding force also decreases as the amount of magnetic flux is reduced due to the low content of iron and the high content of air in the magnetic circuit including the second movable plate.

For a higher thickness of the non-magnetic insert, as shown in graph 405, the locking force in the OFF position will be generally lower. Further, the peak force over the width of the second movable plate will be less distinctive, and it will occur with wider second movable plates.

Figure 5:
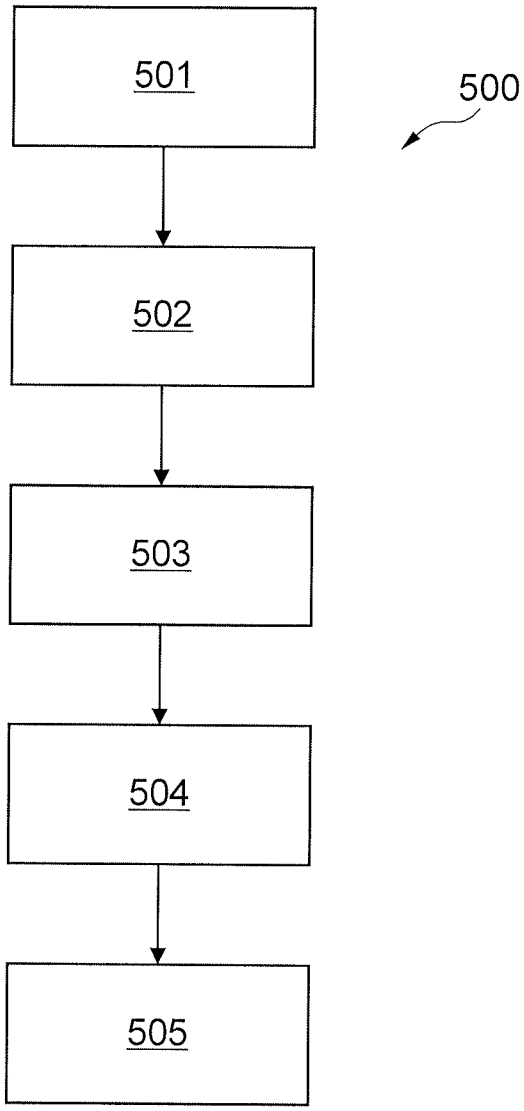
FIG. 5 shows a flow chart of a method of assembling a magnetic actuator unit for a circuit breaker according to an exemplary embodiment of the present disclosure.

FIG. 5 depicts a flow chart of a method 500 of assembling a magnetic actuator unit for a circuit breaker according to an exemplary embodiment of the present disclosure. The exemplary method includes the steps of arranging 501 a coil at a core of the magnetic actuator unit such that the coil generates a magnetic flux in the core, movably arranging 502 a first movable plate on an actuating shaft such that the first movable plate is movable between an ON position and an OFF position of the circuit breaker which is switched ON and OFF by the magnetic actuator unit, such that the first movable plate is attracted by the core to a first position of the core when a magnetic field is generated by the coil. The next step is arranging 503 a non-magnetic flat insert at the other side of the core, for example, opposite to the first moving plate. The last step of the method 500 is arranging 504 a second movable plate below the non-magnetic flat insert and on the same actuating shaft where the first movable plate is arranged so that the non-magnetic flat insert lies between the core and the second movable plate.

The flat insert is configured to adjust a holding force of the magnetic actuator unit provided by the second movable plate at the OFF position. The first movable plate and the second movable plate are spaced apart from one another in a fixed position at a distance, such that, if the first movable plate lifts off from the core with the desired stroke of the magnetic actuator at an OFF position, the second movable plate bears against a non-magnetic flat insert at a second position at the core opposite of the first position generating a holding force of the magnetic actuator unit at the OFF position.

While the present disclosure has been illustrated and described in detail in the drawings and the foregoing description, such illustration and description are to be considered illustrative or exemplary and not restrictive; the present disclosure is not limited to the disclosed exemplary embodiments. Other variations to the disclosed exemplary embodiments can be understood and effected by those skilled in the art and practicing the present disclosure, from a study of the drawings, the disclosure, and the appended claims. In the claims, the word "comprising" or "including" does not exclude other elements or steps, and the indefinite article "a" or "an" does not exclude a plurality. The mere fact that certain measures are recited in mutually different dependent claims does not indicate that a combination of these measures cannot be used to advantage. Any reference symbols in the claims should not be construed as limiting the scope.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

100 magnetic actuator unit
101 core
102 flanks
103 first movable plate
104 actuating shaft
105 coil
106 permanent magnets
107 second movable plate
109 core element
110 non-magnetic flat insert
111 fixing device, screw
112 magnetic flux
200 distance (between the outer ends of the permanent magnets)
201 width or diameter (of the first movable plate)
202 outer end (of the permanent magnet)
203 outer end (of the permanent magnet)
400 diagram of holding force in relation to the width of the second movable plate to the distance between the outer ends of the permanent magnets
401 width of second movable plate axis
402 holding force axis
403 distance between the outer ends of the permanent magnets
404 graph of relatively thin non-magnetic flat insert
405 graph of relatively thick non-magnetic flat insert
d1 distance between first movable plate and second movable plate
d2 distance between second movable plate and core
P1 first position=ON
P2 second position=OFF
T thickness of non-magnetic flat insert
T2 thickness of second movable plate

What is claimed is:

1. A magnetic actuator unit for a circuit breaker, comprising:

a core;

a coil;

an actuating shaft;

a first movable plate;

a second movable plate;

two permanent magnets; and a non-magnetic flat insert arranged between the core and the second movable plate, wherein the first movable plate is configured to be attracted by the core to a first position at a first side of the core when a magnetic field is generated by the coil, and to switch the circuit breaker to an ON position when being attracted by the core, wherein the first movable plate and the second movable plate are spaced apart from one another in a fixed position at a distance, such that when the first movable plate lifts off from the core with a stroke of the magnetic actuator unit to an OFF position, the second movable plate is configured to bear against the non-magnetic flat insert at a second position at a second side of the core opposite of the first position to generate a holding force of the magnetic actuator unit at the OFF position, and wherein the non-magnetic flat insert and the second movable plate are configured to adjust a holding force of the magnetic actuator unit provided by the second movable plate and sufficient for holding the second movable plate at the OFF position against forces that are acting from outside the magnetic actuator unit to the magnetic actuator unit, wherein the magnetic actuator unit comprises a fixing device configured to fix the non-magnetic flat insert to the core, and wherein the non-magnetic flat insert is bended at opposite ends and fixed to the core by at least one screw comprised in the fixing device.

2. The magnetic actuator unit according to claim 1, wherein the non-magnetic flat insert comprises stainless steel.

3. The magnetic actuator unit according to claim 1, wherein the second movable plate is configured to adjust a holding force of the magnetic actuator unit provided by the second movable plate at the OFF position based on a thickness of the second movable plate.

4. A circuit breaker in combination with a magnetic actuator unit according to claim 1, wherein the magnetic actuator unit is configured to switch the circuit breaker.

5. The magnetic actuator unit according to claim 1, wherein the non-magnetic flat insert is configured to adjust a holding force of the magnetic actuator unit provided by the second movable plate at the OFF position based on a thickness of the non-magnetic flat insert.

6. A circuit breaker in combination with a magnetic actuator unit according to claim 5, wherein the magnetic actuator unit is configured to switch the circuit breaker.

7. The magnetic actuator unit according to claim 1, wherein the core comprises:

a core element;

at least two flanks surrounding the core element; and at least two permanent magnets arranged between the core element and the flanks;

wherein the second movable plate is configured to adjust a holding force of the magnetic actuator unit provided by the second movable plate at the OFF position based on a relation of a width of the second movable plate to a distance between outer ends of the permanent magnets.

8. The magnetic actuator unit according to claim 7, wherein the second movable plate is of a round shape and is configured to adjust a holding force of the magnetic actuator unit provided by the second movable plate at the OFF position based on a variation of a diameter of the second movable plate.

9. The magnetic actuator unit according to claim 8, wherein the second movable plate is configured to adjust a holding force of the magnetic actuator unit provided by the second movable plate at the OFF position based on a thickness of the second movable plate.

10. A circuit breaker in combination with a magnetic actuator unit according to claim 9, wherein the magnetic actuator unit is configured to switch the circuit breaker.

11. A method of assembling a magnetic actuator unit for a circuit breaker, the method comprising:

arranging a coil at a core of the magnetic actuator unit such that the coil is configured to generate a magnetic flux in the core;

movably arranging a first movable plate such that the first movable plate is movable on an actuating shaft between an ON position and an OFF position;

arranging a non-magnetic flat insert at another side of the core, opposite to the first moving plate; and arranging a second movable plate below the non-magnetic flat insert and on the same actuating shaft where the first movable plate is arranged so that the non-magnetic flat insert lies between the core and the second movable plate, wherein the non-magnetic flat insert and the second movable plate are configured to adjust a holding force of the magnetic actuator unit provided by the second movable plate and sufficient for holding the second movable plate at the OFF position against outer forces that are acting on the magnetic actuator unit, wherein the magnetic actuator unit comprises a fixing device configured to fix the non-magnetic flat insert to the core, and wherein the non-magnetic flat insert is bended at opposite ends and fixed to the core by at least one screw comprised in the fixing device.

* * * * *